US010548797B2

(12) United States Patent
Yamamoto et al.

(10) Patent No.: US 10,548,797 B2
(45) Date of Patent: Feb. 4, 2020

(54) ASSIST INSTRUMENT

(71) Applicant: NIKON CORPORATION, Tokyo (JP)

(72) Inventors: Masaya Yamamoto, Honjyo (JP); Mikio Owashi, Yokohama (JP); Yusuke Morino, Yokohama (JP); Junya Ishikawa, Yokohama (JP)

(73) Assignee: Nikon Corporation, Tokyo (JP)

( * ) Notice: Subject to any disclaimer, the term of this patent is extended or adjusted under 35 U.S.C. 154(b) by 495 days.

(21) Appl. No.: 14/689,560

(22) Filed: Apr. 17, 2015

(65) Prior Publication Data

US 2015/0216756 A1 Aug. 6, 2015

Related U.S. Application Data

(63) Continuation of application No. PCT/JP2013/006193, filed on Oct. 18, 2013.

(30) Foreign Application Priority Data

Oct. 19, 2012 (JP) ..... 201 2-231 387

(51) Int. Cl.
*A61H 1/02* (2006.01)
*A61H 3/00* (2006.01)
(Continued)

(52) U.S. Cl.
CPC ..... *A61H 1/0237* (2013.01); *A41D 1/005* (2013.01); *A41D 1/06* (2013.01); *A61H 1/008* (2013.01);
(Continued)

(58) Field of Classification Search
CPC ..... A61H 1/02; A61H 1/0237; A61H 1/0262; A61H 1/0274; A61H 1/006; A61H 1/0244;
(Continued)

(56) References Cited

U.S. PATENT DOCUMENTS 5,201,074 A * 4/1993 Dicker ..... A41D 13/0015 2/227
2003/0125781 A1* 7/2003 Dohno ..... A63B 21/00181 607/75
2011/0231986 A1* 9/2011 Waldie ..... B64G 6/00 2/456

FOREIGN PATENT DOCUMENTS

EP 1324403 A1 7/2003
JP 2003-153928 5/2003
(Continued)

OTHER PUBLICATIONS

Extended European Search Report issued by European Patent Office in European Patent Application No. 13646590.1 dated Mar. 22, 2016.

(Continued)

*Primary Examiner* — Colin W Stuart
(74) *Attorney, Agent, or Firm* — Finnegan, Henderson, Farabow, Garrett & Dunner, L.L.P.

(57) ABSTRACT

To wear and remove an assist instrument has been difficult because a user has to wear or remove the assist instrument on or from her/his body in a state that an elastic member is contracted. An assist instrument includes a wearing-removal member that is placed wearably and removably on a body of a user; an assist unit that is provided to the wearing-removal member, and assists muscular strength of the user by an action of at least one of extension and contraction by power supply; a control unit that controls an action of the assist unit; and something that adjusts constriction of the body by the wearing-removal member at a time of at least one of wearing and detachment of the wearing-removal member.

27 Claims, 7 Drawing Sheets

(51) Int. Cl.

| | |
|---|---|
| ***A41D 1/06*** | (2006.01) |
| ***A41D 1/00*** | (2018.01) |
| ***A61H 1/00*** | (2006.01) |

(52) U.S. Cl.

CPC ..... *A61H 1/02* (2013.01); *A61H 1/0244* (2013.01); *A61H 1/0262* (2013.01); *A61H 3/00* (2013.01); *A41D 2300/22* (2013.01); *A41D 2400/38* (2013.01); *A41D 2400/44* (2013.01); *A61H 1/0274* (2013.01); *A61H 2003/002* (2013.01); *A61H 2003/007* (2013.01); *A61H 2201/165* (2013.01)

(58) Field of Classification Search

CPC .. A61H 1/0281; A61H 3/00; A61H 2003/002; A61H 2003/007; A61H 2201/165; A41D 13/00; A41D 13/02; A41D 1/002; A41D 1/005; A41D 1/06; A41D 2300/22; A41D 2400/38; A41D 2400/44

USPC ..... 601/134, 148; 2/69, 69.5, 77, 79, 227

See application file for complete search history.

(56) References Cited

FOREIGN PATENT DOCUMENTS

| | | |
|---|---|---|
| JP | 4345025 | 10/2009 |
| JP | 2010/051416 | 3/2010 |
| WO | WO 2010/028504 A1 | 3/2010 |

OTHER PUBLICATIONS

International Search Report issued by The International Bureau of WIPO in International Application No. PCT/JP2013/006193, dated Nov. 19, 2013 (4 pages).

Notification of Transmittal of Tranlation of the International Preliminary Report on Patentability issued by The International Bureau of WIPO in International Application No. PCT/JP2013/006193, dated Apr. 30, 2015 (6 pages).

Notice of Reasons for Rejection issued by the Japanese Patent Office dated Jul. 4, 2017 in counterpart Japanese Application No. 2014-541957, and English translation thereof.

Office Action issued by the European Patent Office dated May 8, 2017 in counterpart European Application No. 13 846 590.1.

* cited by examiner

ASSIST INSTRUMENT

The contents of the following Japanese and International patent applications are incorporated herein by reference:

No. 2012-231387 filed on Oct. 19, 2012, and

No. PCT/JP2013/006193 filed on Oct. 18, 2013.

BACKGROUND

1. Technical Field

The present invention relates to an assist instrument.

2. Related Art

An assist instrument that assists muscle of a user by an elastic member or the like has been known (for example, please see Patent Literature 1).

[Patent Literature 1] Japanese Patent Application Publication No. 2003-153928

However, an elastic member is extended in a state that the assist instrument is worn, in order to cause the assist instrument to contact the body of the user closely in a state that the assist instrument is worn. For this reason, it is difficult to wear or remove the assist instrument because the user needs to wear or remove the assist instrument while pulling the elastic member.

SUMMARY

A first aspect of the present invention provides an assist instrument comprising:

a wearing-removal member that is placed wearably and removably on a body of a user;

an assist unit that is provided to the wearing-removal member, and assists muscular strength of the user by an action of at least one of extension and contraction by power supply;

a control unit that controls an action of the assist unit; and an adjusting means that adjusts constriction of the body by the wearing-removal member at a time of at least one of wearing and detachment of the wearing-removal member.

A second aspect of the present invention provides an assist instrument comprising:

an assist unit that is attached wearably and removably to a body of a user, and assists muscular strength of the user by an action of at least one of extension and contraction by power supply;

a control unit that controls an action of the assist unit; and an adjusting means that adjusts constriction of the body by the assist unit at a time of at least one of wearing and detachment of the assist unit.

A third aspect of the present invention provides an assist instrument comprising:

a wearing-removal member that is placed wearably and removably on a body of a user;

an assist unit that is provided to the wearing-removal member, and assists muscular strength of the user by at least one of extension and contraction;

an extension-contraction part that is provided to the wearing-removal member, and acts to extend or contract the wearing-removal member by power supply;

a control unit that controls an action of the extension-contraction part; and an adjusting means that adjusts constriction of the body by the wearing-removal member at a time of at least one of wearing and detachment of the wearing-removal member.

A fourth aspect of the present invention provides an assist instrument comprising:

an assist unit that is attached wearably and removably to a body of a user, and assists muscular strength of the user by at least one of extension and contraction; and a control unit that controls the assist unit after wearing of the assist unit to contract the assist unit so that the assist unit contacts the body of the user.

A fifth aspect of the present invention provides an assist instrument comprising:

a wearing-removal member that is fixed wearably and removably to a body of a user, and is extendable and contractable;

an assist unit that is provided to the wearing-removal member, and assists muscular strength of the user by at least one of extension and contraction of the wearing-removal member;

an extension-contraction part that is provided to the wearing-removal member, and causes at least one of extension and contraction of the wearing-removal member; and a control unit that controls the extension-contraction part after wearing of the wearing-removal member to contract the wearing-removal member so that the wearing-removal member contacts the body of the user.

The summary clause does not necessarily describe all necessary features of the embodiments of the present invention. The present invention may also be a sub-combination of the features described above.

DESCRIPTION OF EXEMPLARY EMBODIMENTS

Hereinafter, (some) embodiment(s) of the present invention will be described. The embodiment(s) do(es) not limit the invention according to the claims, and all the combinations of the features described in the embodiment(s) are not necessarily essential to means provided by aspects of the invention.

Figure 1:
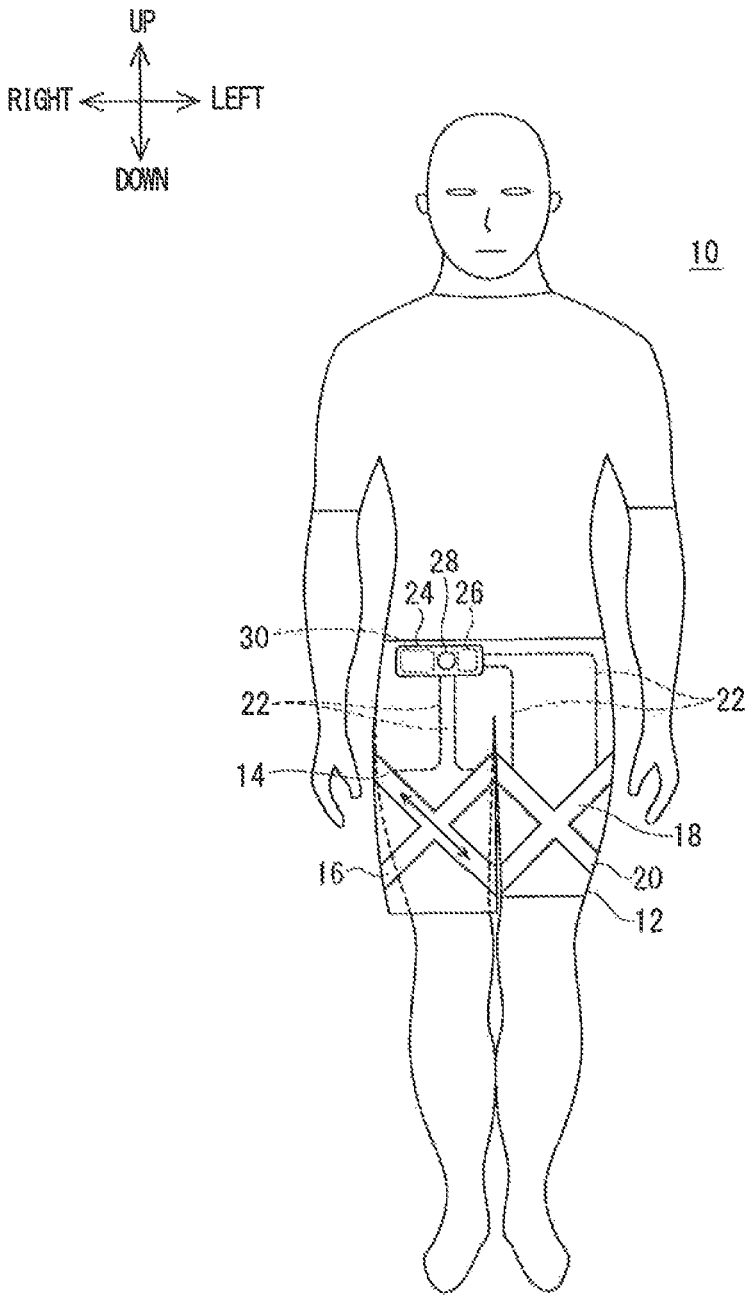
FIG. 1 is a front view of an assist instrument 10 worn by a user.

FIG. 1 is a front view of an assist instrument 10 worn by a user. The upward, downward, leftward and rightward directions indicated with arrows in FIG. 1 are defined as the upward, downward, leftward and rightward directions of the assist instrument 10. Also, the front and rear directions as seen from the user are defined as the front and rear directions of the assist instrument 10.

As shown in FIG. 1, the assist instrument 10 is worn on the lower half of the body of the user, and supports walking or running of the user. The assist instrument 10 comprises a pants portion 12, a first actuator 14, a second actuator 16, a third actuator 18, a fourth actuator 20, wire 22, a housing part 24, a power supply unit 26, an input unit 28, and a control unit 30. The first actuator 14, the second actuator 16, the third actuator 18, and the fourth actuator 20 are one example of an assist unit.

The pants portion 12 is one example of a wearing-removal member. The pants portion 12 has a pants-like shape through which the thigh of the right leg, the thigh of the left leg, and the waist can be inserted. The pants portion 12 is made of extendable and contractable chemical fibers or the like. The pants portion 12 surrounds legs of the user to constrict the legs by certain constraining force. Thereby, the pants portion 12, in a worn state, is fixed to the legs of the user in a state that it is attachable and removable.

The first actuator 14 is provided from the upper right to the lower left of the front surface of pants portion 12 that covers the thigh of the right leg. The first actuator 14 is formed like a belt. The first actuator 14, over its entire length, contacts the pants portion 12 closely by being pasted to the pants portion.

The first actuator 14 includes a polymer material that extends and contracts when power is supplied and voltage is applied. When voltage is applied, the first actuator 14 extends or contracts in the longitudinal direction indicated with an arrow in FIG. 1. In a muscular strength assist state for assisting muscular strength of the user, the first actuator 14 extends and contracts in a fixed state that the first actuator 14 is fixed to the pants portion 12, thereby causing at least one of extension and contraction of a right leg portion of the pants portion 12 to assist the muscular strength of the user that is necessary for raising or lowering the right leg of the user at a time of walking. The first actuator 14 extends at times of wearing and detachment of the pants portion 12, thereby causing extension as indicated at the right leg portion of the pants portion 12 in FIG. 1.

One example of a polymer material is a polyrotaxane crosslinked body. The first actuator 14 is produced by winding a sheet member that is formed by sandwiching both sides of a planar polyrotaxane crosslinked body with extensional and contractional electrodes. Here, the longitudinal direction of the first actuator 14 is parallel with the axial direction of the wound sheet member. Because the first actuator 14 is pliable, it is possible to reduce the sense of discomfort that is felt by the user when she/he walks with the first actuator 14 on. The first actuator 14 extends when voltage is applied. For example, the first actuator 14 extends by its maximum amount when a maximum voltage is applied at a time of wearing or removal. Note that, in the present embodiment, the polymer material of the first actuator 14 is explained as being a polyrotaxane crosslinked body.

Another example of the polymer material is a non-ionic gel. In this case, the first actuator 14 has a pair of outer electrodes, a mesh-like mesh electrode that is arranged between the pair of outer electrodes, and a non-ionic gel that is provided between the mesh electrode and each of the outer electrodes. One example of a non-ionic gel is polyvinyl alcohol gel containing dimethylsulfoxide as a solvent. In this first actuator 14, when voltage that is higher than voltage applied to the outer electrodes is applied to the mesh electrode, negative electric charges are injected from the outer electrodes to the non-ionic gel, and the outer electrodes are attracted toward the mesh electrode. As a result, the distance between the pair of outer electrodes contracts. Conversely, when voltage application is stopped, the distance of the pair of outer electrodes returns to the original state, and extends due to the elastic force of the non-ionic gel. By laminating a plurality of the combination of the outer electrodes, the mesh electrode, and the non-ionic gel, the extension-contraction amount can be increased.

Another example of a polymer material is a polypyrrole film. A polypyrrole film immersed in an electrolyte expands or contracts when voltage is applied. For example, when positive voltage is applied, a polypyrrole film expands. When negative voltage is applied, a polypyrrole film contracts. Also, the first actuator 14 keeps its extended state where voltage application is stopped. Accordingly, voltage application is stopped in a state that the first actuator 14 is extended by the maximum amount by applying a maximum positive voltage. Thereby, the user can attach or remove the pants portion 12 easily after voltage application. Because the first actuator 14, when containing a polypyrrole film, requires an electrolyte, the first actuator 14 needs to be sealed.

The second actuator 16 is provided from the upper left to the lower right of the front surface of the pants portion 12 that covers the thigh of the right leg. Accordingly, the first actuator 14 and the second actuator 16 intersect on the front surface of the thigh of the right leg. The third actuator 18 is provided from the upper left to the lower right of the front surface of the pants portion 12 that covers the thigh of the left leg. The fourth actuator 20 is provided from the upper right to the lower left of the front surface of the pants portion 12 that covers the thigh of the left leg. The third actuator 18 and the fourth actuator 20 intersect on the front surface of the thigh of the left leg. Other configuration of the second actuator 16, the third actuator 18, and the fourth actuator 20 is similar to that of the first actuator 14, and explanation thereof is omitted.

The wire 22 electrically connects the power supply unit 26, and respective ones of the first actuator 14, the second actuator 16, the third actuator 18, and the fourth actuator 20 separately.

The housing part 24 is provided at an upper portion of the pants portion 12. The housing part 24 houses or keeps the power supply unit 26, the input unit 28, and the control unit 30.

The power supply unit 26 is housed in the housing part 24. The power supply unit 26 applies voltage, via four pieces of the wire 22, to respective ones of the first actuator 14, the second actuator 16, the third actuator 18, and the fourth actuator 20 separately.

The input unit 28 is connected to the control unit 30 so that the input unit 28 can transmit signals to the control unit 30. One example of the input unit 28 is a push-button. By operating the input unit 28, the user inputs a wearing-removal instruction when starting wearing or detaching the assist instrument 10. Thereby, the input unit 28 inputs, to the control unit 30, a wearing-removal instruction indicating wearing or detachment of the pants portion 12. As a result, the pants portion 12 is extended by the control unit 30. Also, the user inputs, by the input unit 28, a wearing instruction when completing wearing or removing the assist instrument 10. Thereby, the pants portion 12 is contracted to contact and be fixed to the legs of the user, and assist of walking or running of the user is started. The contraction amount of the pants portion according to an input of a wearing instruction may be preset according to the size of the body of the user, or the contraction amount may be set based on a detection result of a detecting unit that is provided to detect a contraction amount. When the detecting unit is provided, it is detected whether the contraction amount is a contraction amount that causes the assist function of the assist instrument to function appropriately.

The control unit 30 is in charge of the overall control of the assist instrument 10. One example of the control unit 30 is a computer.

Figure 2:
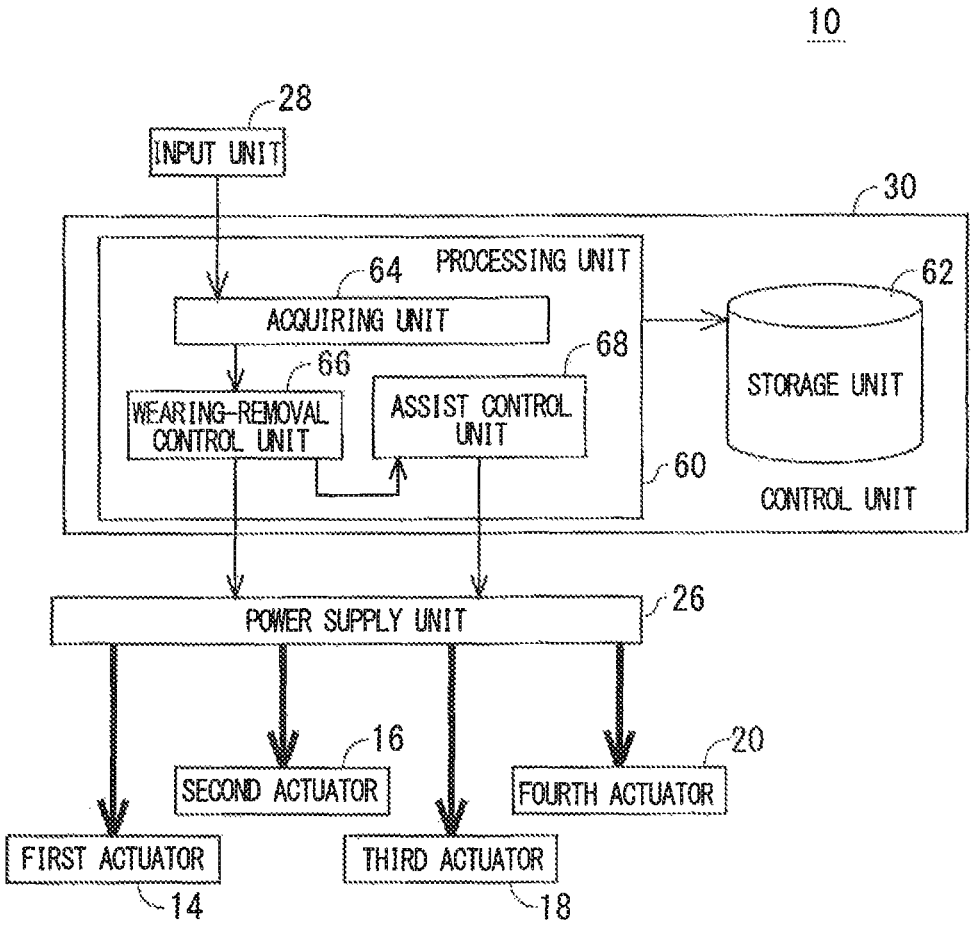
FIG. 2 is a block diagram for explaining a control system of the assist instrument 10.

FIG. 2 is a block diagram for explaining a control system of the assist instrument 10. As shown in FIG. 2, the control unit 30 comprises a processing unit 60 and a storage unit 62. One example of the processing unit 60 is a CPU.

The processing unit 60 functions as an acquiring unit 64, a wearing-removal control unit 66, and an assist control unit 68 by reading out an assist instrument process program stored in the storage unit 62.

The acquiring unit 64 acquires a wearing-removal instruction from the input unit 28. The acquiring unit 64 outputs the acquired wearing-removal instruction to the wearing-removal control unit 66.

Upon acquisition of a first wearing-removal instruction, the wearing-removal control unit 66 judges that is a time of wearing or removal, including a time of wearing or detachment of the pants portion 12. The wearing-removal control unit 66, when having judged that it is a time of wearing or removal, controls the power supply unit 26, thereby controlling the first actuator 14, the second actuator 16, the third actuator 18, and the fourth actuator 20 to extend. Thereby, the wearing-removal control unit 66 extends the pants portion 12 in both the circumferential direction and the up-down direction. The circumferential direction herein means the direction along the circumferences of legs. Also, the up-down direction is one example of a direction that intersects the circumferential direction. One example of the extension amount of the pants portion 12 is an amount of extension of the pants portion 12 as compared with a state where it is worn by the user. The extension amount of the pants portion 12 at a time of wearing or removal is stored in the storage unit 62. The wearing-removal control unit 66, when having acquired a wearing-removal instruction, extends the pants portion 12 based on the extension amount stored in the storage unit 62. Note that a plurality of extension amounts may be stored in the storage unit 62 in association with a plurality of users. In this case, the input unit 28 may identify a user by fingerprint authentication or the like.

Upon acquisition of a second wearing-removal instruction, the wearing-removal control unit 66 controls the power supply unit 26 to stop voltage application to the first actuator 14, the second actuator 16, the third actuator 18, and the fourth actuator 20. Also, the wearing-removal control unit 66 outputs an assist instruction to the assist control unit 68.

Upon acquisition of a wearing-removal instruction after outputting the assist instruction, the wearing-removal control unit 66 outputs an assist stop instruction to the assist control unit 68. After outputting the assist stop instruction, the wearing-removal control unit 66 controls the power supply unit 26 to control voltage applied to the first actuator 14, the second actuator 16, the third actuator 18, and the fourth actuator 20 to extend them. Thereby, the wearing-removal control unit 66 extends the pants portion 12 in both the circumferential direction and the longitudinal direction.

Upon acquisition of a second wearing-removal instruction after outputting an assist instruction, the wearing-removal control unit 66 controls the power supply unit 26 to stop voltage application to the first actuator 14, the second actuator 16, the third actuator 18, and the fourth actuator 20.

Upon acquisition of the assist instruction from the wearing-removal control unit 66, the assist control unit 68 controls the power supply unit 26 to control voltage applied to the first actuator 14, the second actuator 16, the third actuator 18, and the fourth actuator 20 to assist walking or running of the user.

Upon acquisition of an assist stop instruction from the wearing-removal control unit 66, the assist control unit 68 controls the power supply unit 26 to stop voltage application to the first actuator 14, the second actuator 16, the third actuator 18, and the fourth actuator 20.

Figure 3:
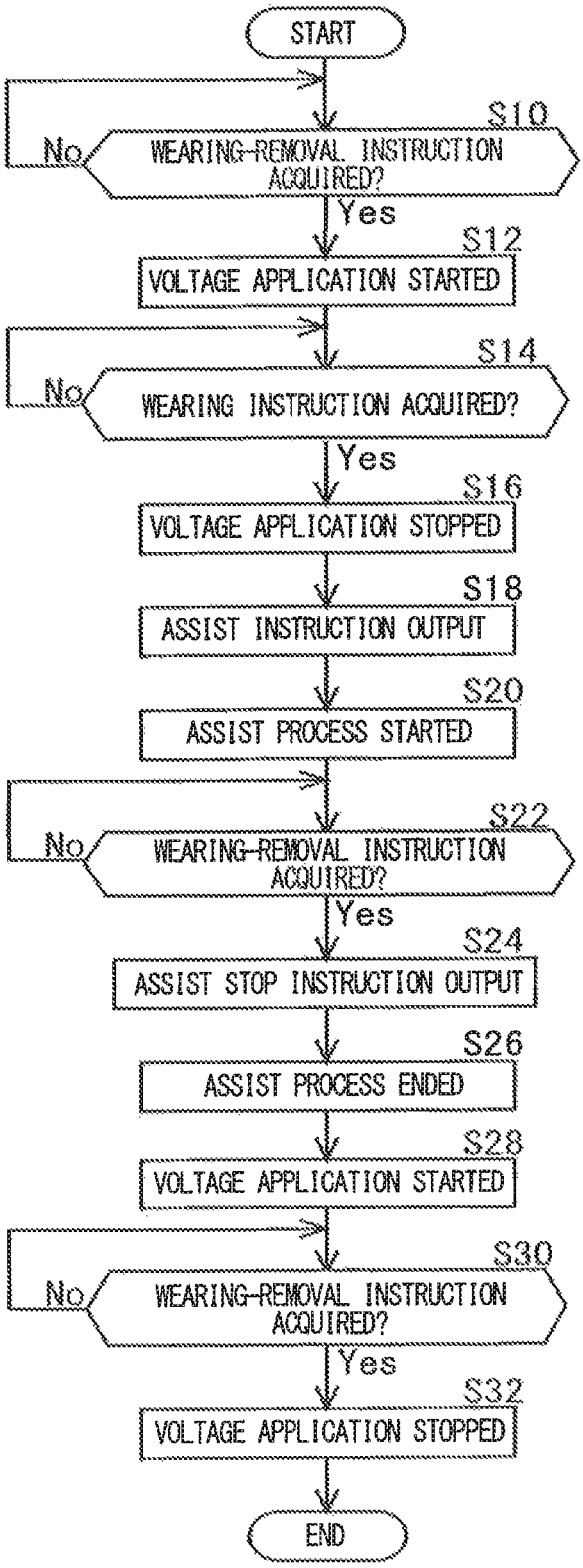
FIG. 3 is a flowchart of an assist instrument process performed by the assist instrument 10.

FIG. 3 is a flowchart of an assist instrument process performed by the assist instrument 10. The assist instrument process is performed by the processing unit 60 reading out an assist instrument program stored in the storage unit 62.

As shown in FIG. 3, in the assist instrument process, the wearing-removal control unit 66 judges whether a wearing-removal instruction has been acquired (S10). The wearing-removal control unit 66 is in a standby state until the wearing-removal control unit 66 acquires a wearing-removal instruction via the acquiring unit 64 (S10: No). Upon operation of the input unit 28 by the user, if the wearing-removal control unit 66 acquires a wearing-removal instruction via the acquiring unit 64 (S10: Yes), the wearing-removal control unit 66 controls the power supply unit 26 to apply voltage to the first actuator 14, the second actuator 16, the third actuator 18, and the fourth actuator 20 (S12). Thereby, the pants portion 12 extends in the circumferential direction and the longitudinal direction. The user wears the extended pants portion 12, together with the first actuator 14, the second actuator 16, the third actuator 18, and the fourth actuator 20.

Next, after the user finishes wearing the pants portion 12, and when the user inputs a wearing-removal instruction by operating the input unit 28, the wearing-removal control unit 66 acquires the wearing-removal instruction from the input unit 28 via the acquiring unit 64 (S14: Yes). Thereby, the wearing-removal control unit 66 controls the power supply unit 26 to stop voltage application to the first actuator 14, the second actuator 16, the third actuator 18, and the fourth actuator 20 (S16). Next, the wearing-removal control unit 66 outputs an assist instruction to the assist control unit 68 (S18).

Upon acquisition of the assist instruction, the assist control unit 68 starts an assist process (S20). In the assist process, the assist control unit 68 controls the power supply unit 26 to control voltage applied to the first actuator 14, the second actuator 16, the third actuator 18, and the fourth actuator 20 separately. Thereby, the first actuator 14, the second actuator 16, the third actuator 18, and the fourth actuator 20 assist raising and lowering of the legs of the user to support walking and running.

For example, when the user raises the right leg, the assist control unit 68 controls voltage applied to the first actuator 14 and the second actuator 16 via the power supply unit 26 to contract the first actuator 14 and the second actuator 16. Note that a method of contraction may be realized by stopping voltage application, or may be realized by lowering applied voltage. Conversely, when the user lowers the right leg, the assist control unit 68 controls voltage applied to the first actuator 14 and the second actuator 16 via the power supply unit 26 to extend the first actuator 14 and the second actuator 16. In a case of raising and lowering the left leg, the assist control unit 68 controls extension and contraction of the third actuator 18 and the fourth actuator 20 via the power supply unit 26. Here, the assist control unit 68 controls voltage application based on voltage values and time intervals predetermined and stored in the storage unit 62.

Also, when the user moves rightward, the assist control unit 68 controls voltage applied to the first actuator 14 and the fourth actuator 20 via the power supply unit 26 to contract the first actuator 14 and the fourth actuator 20. Also, when the user moves leftward, the assist control unit 68 controls voltage applied to the second actuator 16 and the third actuator 18 via the power supply unit 26 to contract the second actuator 16 and the third actuator 18.

Then, until the wearing-removal control unit 66 acquires a wearing-removal instruction (S22: No), the assist control unit 68 continues the assist process. Upon acquisition of a wearing-removal instruction via the acquiring unit 64 (S22: Yes), the wearing-removal control unit 66 outputs an assist stop instruction to the assist control unit 68 (S24). Thereby, the assist control unit 68 ends the assist process (S26). The wearing-removal control unit 66 controls the power supply unit 26 to start voltage application to the first actuator 14, the second actuator 16, the third actuator 18, and the fourth actuator 20 (S28). Thereby, the pants portion 12 extends in the circumferential direction and the longitudinal direction.

Then, the wearing-removal control unit 66 continues voltage application and is in a standby state until a wearing-removal instruction is acquired (S30: No). Upon acquisition of a wearing-removal instruction via the acquiring unit 64, the wearing-removal control unit 66 controls the power supply unit 26 to stop voltage application to the first actuator 14, the second actuator 16, the third actuator 18, and the fourth actuator 20 (S32). Note that the wearing-removal control unit 66 may terminate its operation in a state that the pants portion 12 is contracted, or terminate its operation in a state that the pants portion 12 is extended. Thereby, the assist instrument process ends.

As mentioned above, in the assist instrument 10, at a time when the user wears or removes the pants portion 12, the wearing-removal control unit 66 extends the first actuator 14, the second actuator 16, the third actuator 18, and the fourth actuator 20, thereby extending the pants portion 12. Thereby, the user can wear or remove the pants portion 12 easily.

Next, an embodiment that is attained by modifying the above-mentioned embodiment is explained.

Figure 4:
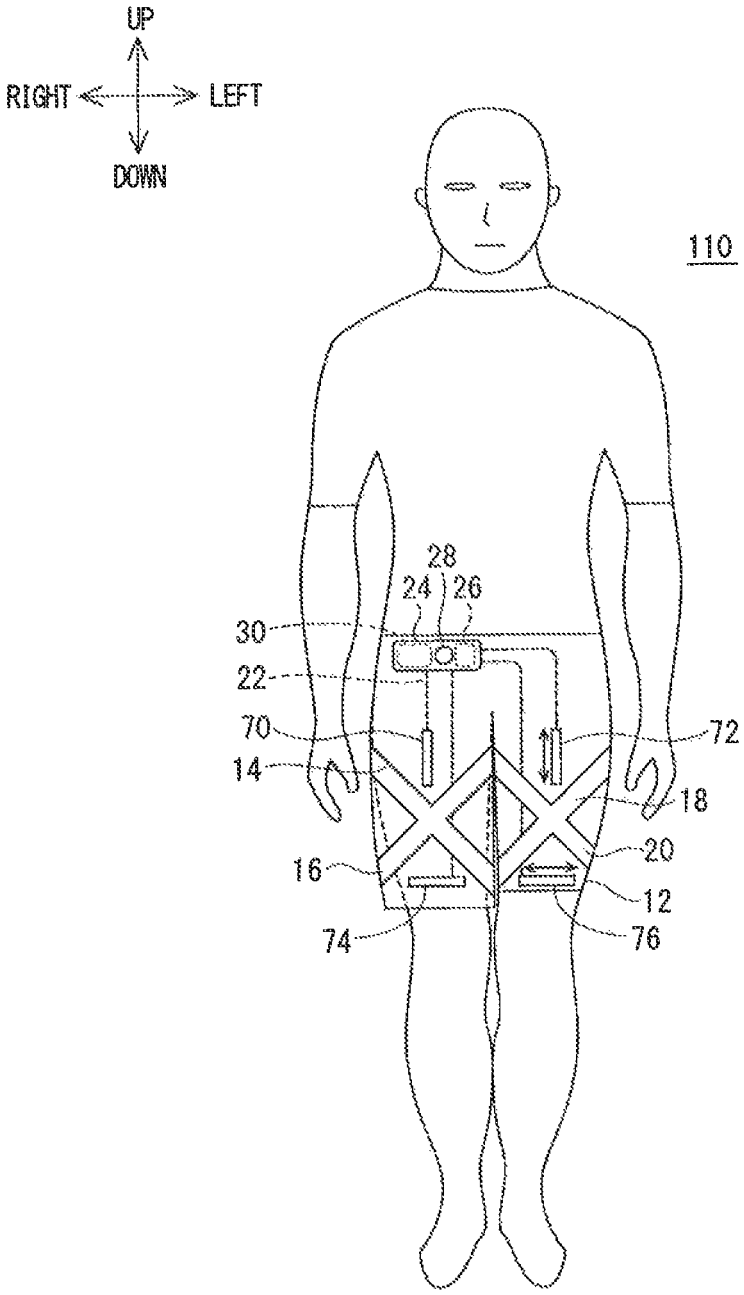
FIG. 4 is a front view of an assist instrument 110 to which sub extension-contraction parts are provided.

FIG. 4 is a front view of an assist instrument 110 to which sub extension-contraction parts are provided. As shown in FIG. 4, the assist instrument 110 further comprises a first sub extension-contraction part 70, a second sub extension-contraction part 72, a third sub extension-contraction part 74, and a fourth sub extension-contraction part 76. The pants portion 12 that is one example of a clothing member to be worn and removed on and from the body of the user, the first sub extension-contraction part 70, the second sub extension-contraction part 72, the third sub extension-contraction part 74, and the fourth sub extension-contraction part 76 are one example of a wearing-removal member.

The first sub extension-contraction part 70 is provided to the pants portion 12 at a portion that corresponds to an upper portion of the right leg. The second sub extension-contraction part 72 is provided to the pants portion 12 at a portion that corresponds to an upper portion of the left leg. The first sub extension-contraction part 70 and the second sub extension-contraction part 72 are formed in a rectangular shape along the up-down direction.

The third sub extension-contraction part 74 is provided to the pants portion 12 at a portion that corresponds to a lower portion of the right leg. The fourth sub extension-contraction part 76 is provided to the pants portion 12 that corresponds to a lower portion of the left leg. The third sub extension-contraction part 74 and the fourth sub extension-contraction part 76 are formed in a rectangular shape along the horizontal direction.

Upon operation of the input unit 28 by the user to input a wearing-removal instruction, the wearing-removal control unit 66 controls the first sub extension-contraction part 70, the second sub extension-contraction part 72, the third sub extension-contraction part 74, and the fourth sub extension-contraction part 76 by applying voltage to them, at a time of at least one of wearing and detachment of the pants portion 12. Thereby, the first sub extension-contraction part 70 and the second sub extension-contraction part 72 extend in the up-down direction to extend, in the longitudinal direction, the pants portion 12 in a contracted state as indicated at the right leg portion in FIG. 4. On the other hand, the third sub extension-contraction part 74 and the fourth sub extension-contraction part 76 extend in the horizontal direction to extend, in the circumferential direction, the pants portion 12 in a contracted state as indicated at the right leg portion in FIG. 4. Thereby, the user can wear or remove the pants portion 12 easily. In the example shown in FIG. 4, at a time of at least one of wearing and detachment of the pants portion 12, the wearing-removal control unit 66 may extend the pants portion 12 by controlling the first actuator 14, the second actuator 16, the third actuator 18, and the fourth actuator 20, in addition to by controlling the first sub extension-contraction part 70, the second sub extension-contraction part 72, the third sub extension-contraction part 74, and the fourth sub extension-contraction part 76.

Figure 5:
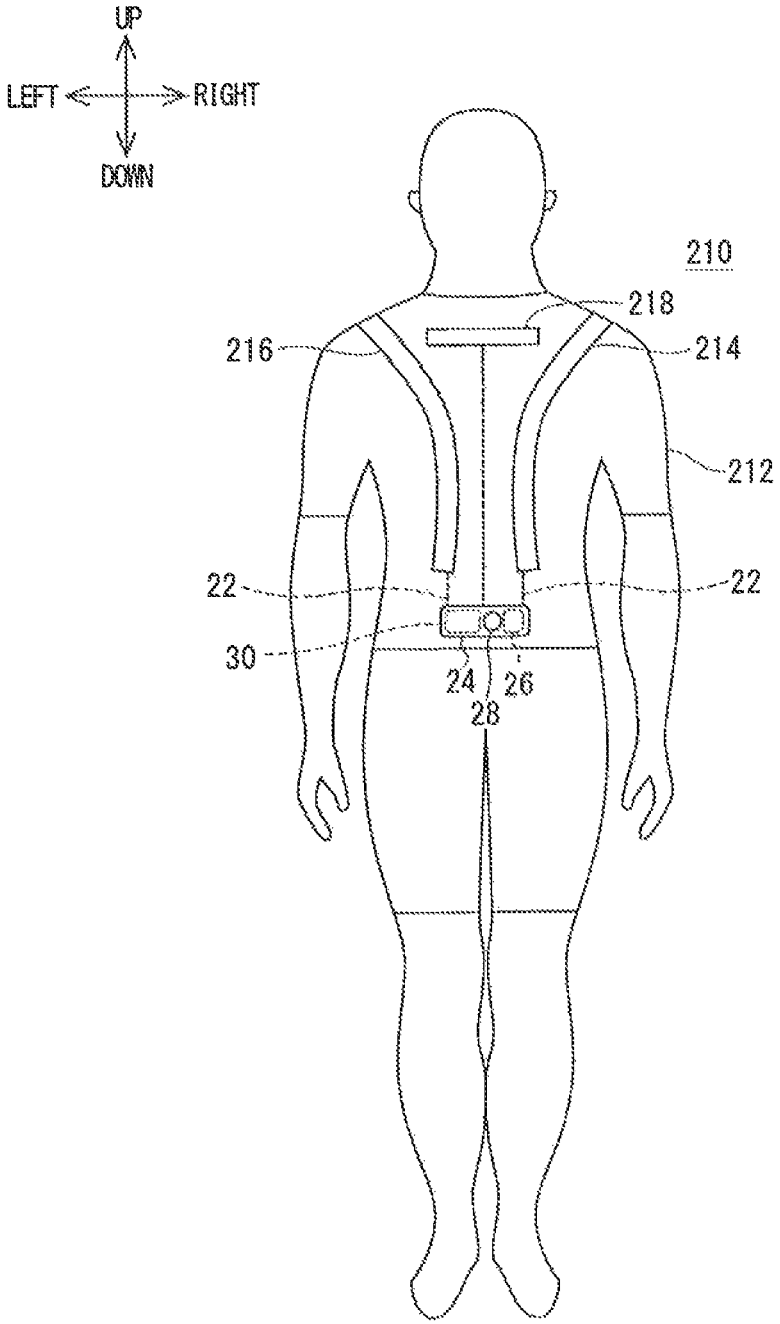
FIG. 5 is a front view of an assist instrument 210 worn by a user.

FIG. 5 is a front view of an assist instrument 210 worn by a user. As shown in FIG. 5, the assist instrument 210 comprises a shirt portion 212, a first actuator 214, a second actuator 216, a third actuator 218, the wire 22, the housing part 24, the power supply unit 26, the input unit 28, and the control unit 30.

The shirt portion 212 is one example of a wearing-removal member. The shirt portion 212 has a shirt-like shape through which the upper arm of the right arm, the upper arm of the left arm, and the upper body can be inserted. The shirt portion 212 is made of extendable and contractable chemical fibers or the like. The shirt portion 212 surrounds the upper body of the user to constrict the upper body of the user by certain constraining force. Thereby, the shirt portion 212, in a worn state, is fixed to the upper body of the user.

The first actuator 214 is provided to the shirt portion 212 from the right shoulder of the user to the right portion of the back surface of the waist. The second actuator 216 is provided to the shirt portion 212 from the left shoulder of the user to the left portion of the back surface of the waist. The third actuator 218 is provided to the shirt portion 212 at an upper portion of the back of the user so as to extend in the horizontal direction.

In the assist instrument 210, upon operation of the input unit 28 by the user to input a wearing-removal instruction, the wearing-removal control unit 66 controls the power supply unit 26 to apply voltage to the first actuator 214, the second actuator 216, and the third actuator 218 to extend them. Thereby, the first actuator 214 and the second actuator 216 extend along approximately the up-down direction. As a result, the shirt portion 212 extends in the longitudinal direction. Also, the third actuator 218 extends in the horizontal direction. Thereby, the shirt portion 212 extends in the circumferential direction. As a result, the user can wear the shirt portion 212 easily.

When assisting the muscular strength of the user, the assist instrument 210 extends and contracts the first actuator 214 and the second actuator 216. Thereby, the user can lift baggage and the like placed on the floor easily. Also, the assist instrument 210 can correct the posture of the user by contracting the third actuator 218.

Figure 6:
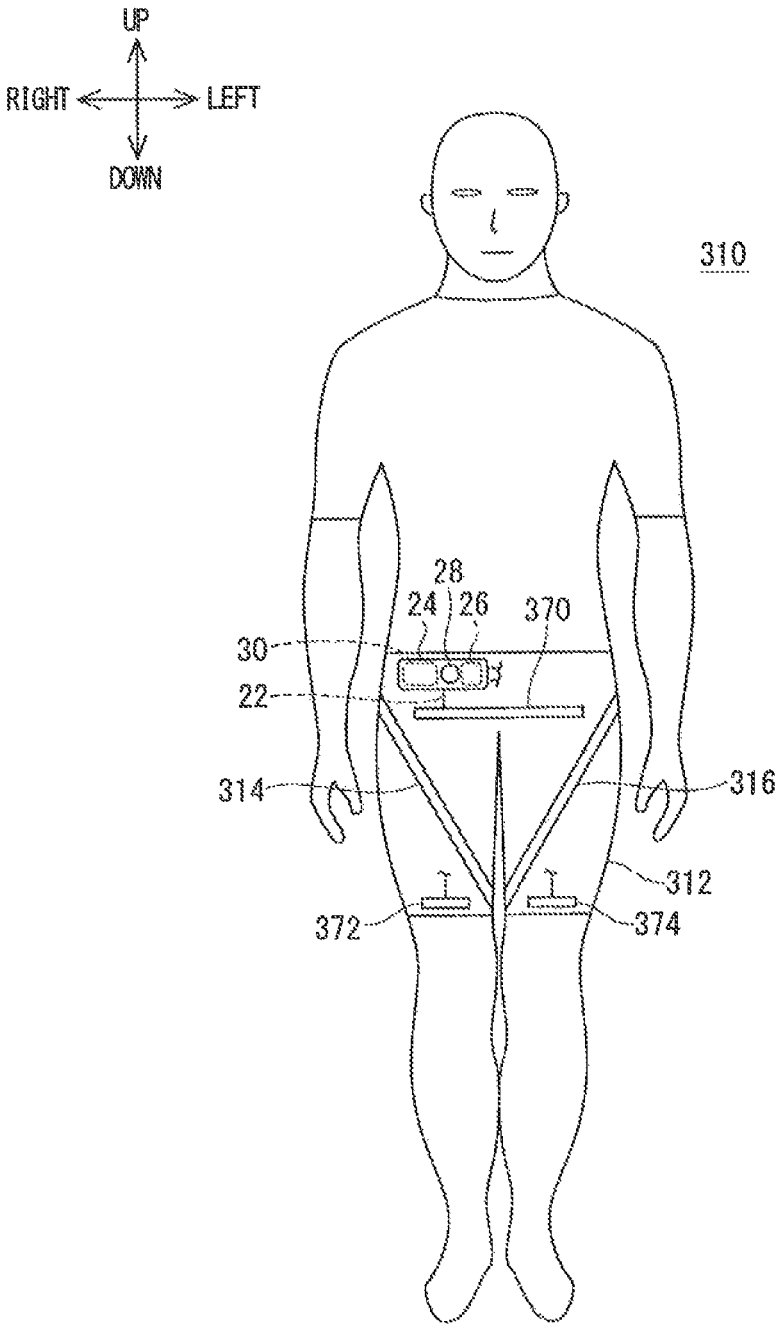
FIG. 6 is a front view of an assist instrument 310 worn by a user.

FIG. 6 is a front view of an assist instrument 310 worn by the user. The assist instrument 310 comprises a pants portion 312, a first elastic member 314, a second elastic member 316, a first sub extension-contraction part 370, a second sub extension-contraction part 372, a third sub extension-contraction part 374, the wire 22, the housing part 24, the power supply unit 26, the input unit 28, and the control unit 30.

The first elastic member 314 is provided from the upper right to the lower left of the front surface of the pants portion 312 that covers the thigh of the right leg. The second elastic member 316 is provided from the upper left to the lower right of the front surface of the pants portion 12 that covers the thigh of the left leg. The first elastic member 314 and the second elastic member 316, in a state that the pants portion 312 is worn by the user, exerts the elastic force on the legs of the user so as to raise the legs.

The first sub extension-contraction part 370 is provided on the front surface of the pants portion 312 that covers the waist. The first sub extension-contraction part 370 extends in the horizontal direction. The second sub extension-contraction part 372 is provided to the front surface of the pants portion 312 that covers a lower portion of the thigh of the right leg. The second sub extension-contraction part 372 extends in the horizontal direction. The third sub extension-contraction part 374 is provided to the front surface of the pants portion 312 that covers a lower portion of the thigh of the left leg. The third sub extension-contraction part 374 extends in the horizontal direction.

In the assist instrument 310, at a time of wearing or removal of the pants portion 312, the wearing-removal control unit 66 extends the first sub extension-contraction part 370, the second sub extension-contraction part 372, and the third sub extension-contraction part 374. Thereby, because the pants portion 312 extends in the circumferential direction, the user can wear the pants portion 312 easily.

Although FIGS. 1 to 6 showed examples in which the assist units are the first actuator 14, the second actuator 16, the third actuator 18, and the fourth actuator 20 that are controlled to extend or contract electrically by the control unit 30, instead of this, for example, an assist unit that has an elastic body like rubber, and is not electrically controlled may be used. In this case, at a time of wearing or removal of the pants portion 312, by extending, by the wearing-removal control unit 66, the first sub extension-contraction part 70, the second sub extension-contraction part 72, the third sub extension-contraction part 74, and the fourth sub extension-contraction part 76 respectively, the pants portion 312 is extended. The respective extension amounts of the first sub extension-contraction part 70, the second sub extension-contraction part 72, the third sub extension-contraction part 74, and the fourth sub extension-contraction part 76 are set to amounts that cause formation of space between the pants portion 312 and the body of the user that is sufficient for the user to remove the pants portion 312, and the extending force is set to force that causes extension not only of the pants portion 312 but also of the assist units. Also, when the assist units have both an elastic body and an actuator that is electrically controlled to extend or contract like the first actuator 14, the second actuator 16, the third actuator 18, and the fourth actuator 20, the pants portion 312 may be extended by extending the actuator by the wearing-removal control unit 66 at a time of wearing or removal of the pants portion 312. In this case, the extending force of the actuator is set to force that causes extension of the wearing-removal member and the elastic body respectively.

Figure 7:
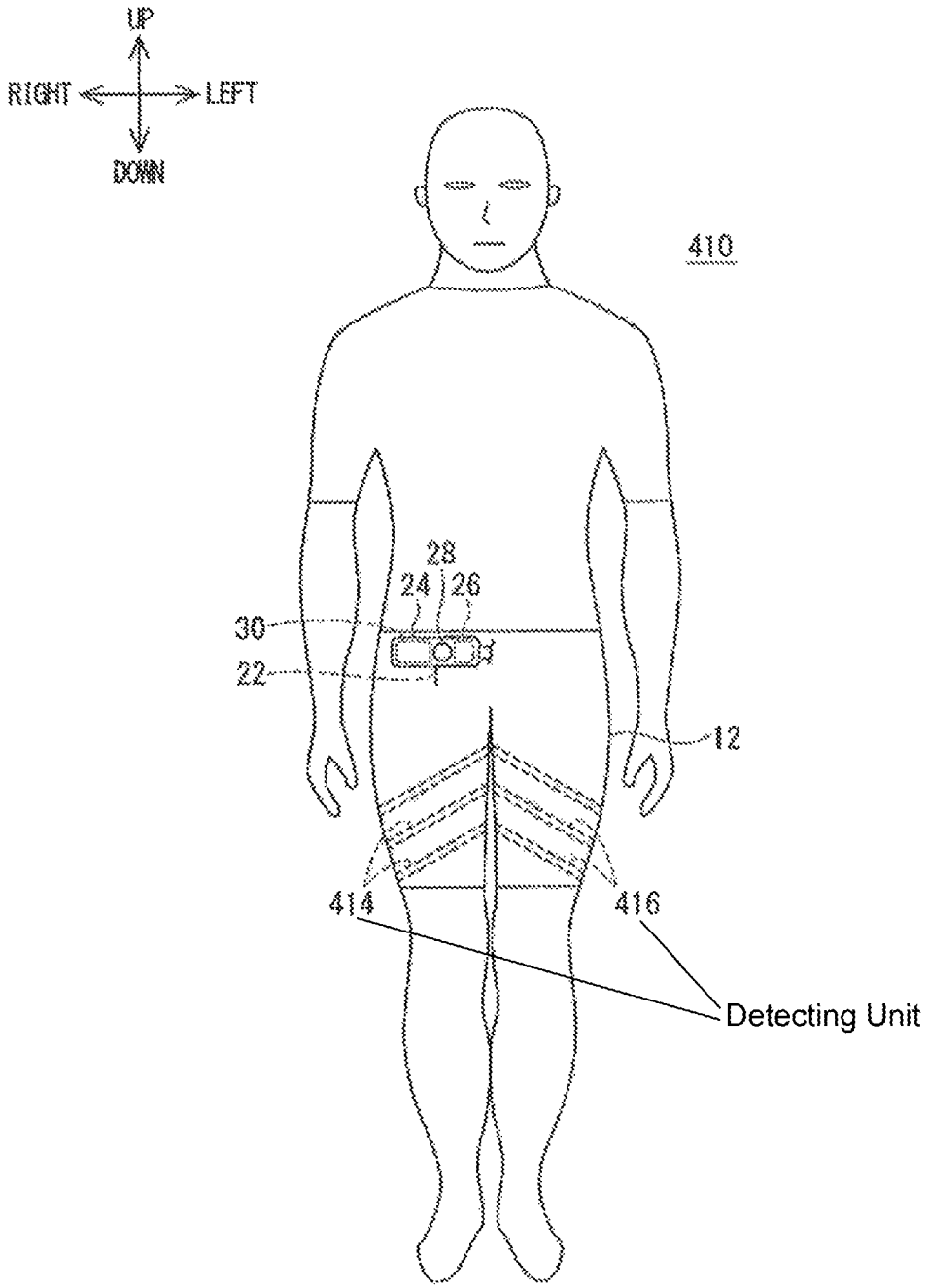
FIG. 7 is a front view of an assist instrument 410 worn by a user.

FIG. 7 is a front view of an assist instrument 410 worn by a user. The assist instrument 410 comprises a first actuator 414, a second actuator 416, the wire 22, the housing part 24, the power supply unit 26, the input unit 28, and the control unit 30. The first actuator 414 is attached wearably and removably to the right leg of the user. The first actuator 414 is, when it is worn, attached by being wound around the right leg of the user multiple times. The second actuator 416 is attached wearably and removably to the left leg of the user. The second actuator 416 is, when it is worn, attached by being wound around the left leg of the user. Upon receiving an input by the user via the input unit 28, indicating that it is a time of wearing or removal, the wearing-removal control unit 66 controls the first actuator 414 and the second actuator 416 at a time of at least one of wearing and detachment to extend the first actuator 414 and the second actuator 416.

The shapes, arrangement, values such as numbers, materials, and the like of the configuration of each of the above-mentioned embodiments may be modified as appropriate. Also, the above-mentioned embodiments may be combined as appropriate.

Although in the above-mentioned embodiments, the user inputs a wearing-removal instruction by using the input unit 28, wearing or removal by the user may be detected automatically. In this case, the assist instrument has a detecting unit that detects an extension-contraction state of the pants portion 12 to output the length of the extended pants portion 12 as an extension-contraction value. One example of the detecting unit is a pressure sensor. Also, each of the above-mentioned actuator may share the detecting unit. Upon receiving external force, the above-mentioned actuators generate electromotive force. The detecting unit shared by the actuators detects, based on this electromotive force, an extension-contraction value that is one example of an extension-contraction state of the pants portion 12. The wearing-removal control unit 66 compares an extension-contraction value acquired from the detecting unit and an extension-contraction threshold stored in the storage unit 62. If the extension-contraction value is equal to or higher than the extension-contraction threshold, the detecting unit judges that it is a time of wearing or removal when the user wears or removes the pants portion 12 to output a wearing-removal instruction to the wearing-removal control unit 66. An example of a case where the detecting unit judges that it is a time of wearing or removal is when the user pulls rubber of the waist portion of the pants portion 12 by a predetermined length or longer. Thereby, the wearing-removal control unit 66 extends the actuators to extend the pants portion 12.

Although in the above-mentioned embodiments, an extension amount is stored in the storage unit 62, and each actuator is extended and contracted at a time of wearing or removal based on the extension amount, the wearing-removal control unit 66 may calculate the extension amount and the contraction amount. The wearing-removal control unit 66 may calculate the extension amount and the contraction amount at a time of wearing or removal of the pants portion 12 or the like based on physical information of the user stored in the storage unit 62 to extend or contract the pants portion 12. Also, by further providing an image-capturing unit to capture an image of the user, the wearing-removal control unit 66 may calculate physical information based on the image of the user captured by the image-capturing unit.

Each actuator may be a type that extends due to voltage application, or may be a type that contracts due to voltage application, and extends by the maximum amount when voltage is not applied. In a case of the type that contracts due to voltage application, a wearing-removal member is extended by extension of the actuators, by stopping voltage application when detaching the wearing-removal member. In this case, the extension amount of the actuators is set so that the extension amount of the wearing-removal member becomes larger when voltage is not applied than the extension amount at a time of wearing, Although the above-mentioned embodiments showed examples in which actuators such as the first actuator 14 are extended at times of both wearing and detachment of a wearing-removal member such as the pants portion 12, the actuators may be extended at a time of at least one of wearing and detachment of the wearing-removal member. Although the above-mentioned embodiments showed examples in which actuators such as the first actuator 14 are extended at a time of at least one of wearing and detachment of a wearing-removal member such as the pants portion 12, an actuator may be provided to a pants portion having a size larger than the body of the user, for example, larger than the thickness of a leg, and the actuator may be contracted so that the pants portion contacts the body by controlling the actuator and a sub extension-contraction part after the pants portion is worn. In this case also, similarly to the above-described case, the contraction amount of the pants portion as input by a wearing instruction may be set in advance according to the size of the body of the user, or a detecting unit to detect the contraction amount may be provided, and the contraction amount may be set based on its detection result. When the detecting unit is provided, it is detected whether the contraction amount is a contraction amount with which the assist function of the assist instrument functions appropriately.

While the embodiment(s) of the present invention has (have) been described, the technical scope of the invention is not limited to the above described embodiment(s). It is apparent to persons skilled in the art that various alterations and improvements can be added to the above-described embodiment(s). It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

What is claimed is:

1. An assist instrument comprising:

a wearing-removal member that is adapted to be placed wearably and removably on a body of a user;

an assist unit that is provided to the wearing-removal member, and is adapted to assist muscular strength of the user at a time of moving of the user by an action of at least one of extension and contraction in accordance with a power supply;

a control unit that controls an action of the assist unit; and a detecting unit that is provided to detect an extension-contraction value of the wearing-removal member;

wherein the control unit controls the action of the assist unit at a time of at least one of putting on and taking off the wearing-removal member to extend the assist unit, thereby extending the wearing-removal member; and the control unit automatically extends the assist unit when the extension-contraction value is equal to or higher than an extension-contraction threshold such that the wearing-removal member is deformed in a direction that causes formation of space between the wearing-removal member and the user at a time of at least one of putting on and taking off the wearing-removal member.

2. The assist instrument according to claim 1, wherein the assist unit has an elastic body, and extending force of the assist unit extends the wearing-removal member and the elastic body, respectively.

3. The assist instrument according to claim 1, further comprising: an extension-contraction part that extends and contracts the wearing-removal member, and the control unit controls the extension-contraction part at a time of at least one of putting on and taking off the wearing-removal member to extend the extension-contraction part, thereby extending the wearing-removal member.

4. The assist instrument according to claim 1, further comprising: an extension-contraction part that extends and contracts the wearing-removal member, wherein the control unit controls the extension-contraction part after putting on the wearing-removal member to contract the wearing-removal member so that the wearing-removal member contacts the body of the user.

5. The assist instrument according to claim 1, wherein the control unit controls the assist unit after putting on the wearing-removal member to contract the wearing-removal member so that the wearing-removal member contacts the body of the user.

6. The assist instrument according to claim 1, wherein the assist unit comprises at least two actuators, each actuator of the at least two actuators adapted to extend and contract the wearing-removal member, the extending and contracting of the at least two actuators being in different directions.

7. The assist instrument according to claim 1, wherein the detecting unit is a pressure sensor.

8. The assist instrument according to claim 1, wherein the detecting unit detects the extension-contraction value based on an electromotive force that occurs in accordance with extension-contraction value.

9. An assist instrument comprising:

an assist unit that is adapted to be wearably and removably attached to a body of a user, and is adapted to assist muscular strength of the user at a time of moving of the user by an action of at least one of extension and contraction in accordance with a power supply;

a control unit that controls an action of the assist unit; and a detecting unit that is provided to detect an extension-contraction value of a wearing-removal member;

wherein the control unit adjusts constriction of the body by the assist unit at a time of at least one of putting on and taking off the assist unit to extend the assist unit, thereby extending a wearing-removal member; and the control unit automatically extends the assist unit when the extension-contraction value is equal to or higher than an extension-contraction threshold such that the assist unit is deformed in a direction that causes formation of space between the assist unit and the user at a time of at least one of putting on and taking off the assist unit.

10. The assist instrument according to claim 9, comprising a wearing-removal member that is adapted to be fixed wearably and removably to the body of the user, and is extendable and contractable, wherein the assist unit is provided to the wearing-removal member, and is adapted to assist muscular strength of the user by at least one of extension and contraction of the wearing-removal member, and the control unit controls the assist unit at a time of at least one of putting on and taking off the wearing-removal member to extend the assist unit, thereby extending the wearing-removal member.

11. The assist instrument according to claim 9, comprising a wearing-removal member that is adapted to be fixed wearably and removably to the body of the user, and is extendable and contractable, wherein the assist unit has an elastic body, and extending force of the assist unit extends the wearing-removal member and the elastic body, respectively.

12. The assist instrument according to claim 9, wherein the control unit controls the assist unit after putting on the assist unit to contract the assist unit so that the assist unit contacts the body of the user.

13. The assist instrument according to claim 1, wherein the control unit extends and contracts the wearing-removal member based on an extension-contraction amount of the wearing-removal member at a time of putting on or taking off.

14. The assist instrument according to claim 1, wherein the control unit extends and contracts the wearing-removal member based on an extension-contraction amount of the wearing-removal member at a time of putting on or taking off, the extension-contraction amount being calculated from physical information of the user.

15. The assist instrument according to claim 9, further comprising an input unit from which an instruction when completing the at least one of putting on and taking off the wearing-removal member is input;

wherein the control unit adjusts a contraction amount of the assist unit based on the instruction from the input unit to contract the assist unit, thereby contracting the wearing-removal member.

16. An assist instrument comprising:

a wearing-removal member that is adapted to be placed wearably and removably on a body of a user;

an assist unit that is provided to the wearing-removal member, and is adapted to assist muscular strength of the user at a time of moving of the user by at least one of extension and contraction;

an extension-contraction part that is provided to the wearing-removal member, and acts to extend or contract the wearing-removal member in accordance with a power supply;

a control unit that controls an action of the extension-contraction part; and a detecting unit that is provided to detect an extension-contraction value of the wearing-removal member;

wherein the control unit adjusts constriction of the body by the wearing-removal member at a time of at least one of putting on and taking off the wearing-removal member to extend the extension-contraction part, thereby extending the wearing-removal member; and the control unit automatically extends the extension-contraction part when the extension-contraction value is equal to or higher than an extension-contraction threshold such that the extension-contraction part is deformed in a direction that causes formation of space between the wearing-removal member and the user at a time of at least one of putting on and taking off the wearing-removal member.

17. The assist instrument according to claim 16, wherein the assist unit is an elastic body, and extending force of the extension-contraction part extends the wearing-removal member and the elastic body, respectively.

18. The assist instrument according to claim 16, further comprising an input unit from which an instruction when completing the at least one of putting on and taking off the wearing-removal member is input;

wherein the control unit adjusts a contraction amount of the extension-contraction part based on the instruction to contract the extension-contraction part from the input unit, thereby contracting the wearing-removal member.

19. An assist instrument comprising:

an assist unit that is adapted to be wearably and removably attached to a body of a user, and is adapted to assist muscular strength of the user at a time of moving of the user by at least one of extension and contraction;

a detecting unit that is provided to detect an extension-contraction value of a wearing-removal member; and a control unit that controls the assist unit after putting on the assist unit to contract the assist unit so that the assist unit contacts the body of the user, wherein the control unit automatically extends the assist unit when the extension-contraction value is equal to or higher than an extension-contraction threshold such that the assist unit is deformed in a direction that causes formation of space between the assist unit and the user at a time of at least one of putting on and taking off.

20. The assist instrument according to claim 19, comprising a wearing-removal member that is adapted to be fixed wearably and removably to the body of the user, and is extendable and contractable, wherein the control unit extends and contracts the wearing-removal member based on an extension-contraction amount of the wearing-removal member at a time of putting on or taking off.

21. The assist instrument according to claim 19, comprising a wearing-removal member that is adapted to be fixed wearably and removably to the body of the user, and is extendable and contractable, wherein the control unit extends and contracts the wearing-removal member based on an extension-contraction amount of the wearing-removal member at a time of putting on or taking off, the extension-contraction amount being calculated from physical information of the user.

22. The assist instrument according to claim 19, wherein the control unit controls the assist unit to adjust constriction of the body of the user.

23. An assist instrument comprising:

a wearing-removal member that is adapted to be fixed wearably and removably to a body of a user, and is extendable and contractable;

an assist unit that is provided to the wearing-removal member, and is adapted to assist muscular strength of the user at a time of moving of the user;

an extension-contraction part that is provided to the wearing-removal member, and causes at least one of extension and contraction of the wearing-removal member;

a detecting unit that is provided to detect an extension-contraction value of the wearing-removal member; and a control unit that controls the extension-contraction part after putting on of the wearing-removal member to contract the wearing-removal member so that the wearing-removal member contacts the body of the user, wherein the control unit automatically extends the wearing-removal member when the extension-contraction value is equal to or higher than an extension-contraction threshold such that the wearing-removal member is deformed in a direction that causes formation of space between the wearing-removal member and the user at a time of at least one of putting on and taking off.

24. The assist instrument according to claim 23, wherein the control unit controls the extension-contraction part at a time of at least one of putting on and taking off the wearing-removal member to extend the assist unit, thereby extending the wearing-removal member.

25. The assist instrument according to claim 23, wherein the extension-contraction part comprises at least two actuators, each actuator of the at least two actuators adapted to extend and contract the wearing-removal member, the extending and contracting of the at least two actuators being in different directions.

26. The assist instrument according to claim 23, further comprising an input unit from which a wearing-removal instruction of the wearing-removal member is input.

27. The assist instrument according to claim 23, wherein the control unit controls the assist unit to adjust constriction of the body of the user.

* * * * *